US005498192A

United States Patent [19]

McKay et al.

[11] Patent Number: 5,498,192

[45] Date of Patent: *Mar. 12, 1996

[54] TOP WITH PRECESSION TRACING POINT FOR TRACING UNIQUE SPIRALS

[75] Inventors: Christopher B. McKay; Stephen deZordo, both of Carmel, Calif.

[73] Assignee: DoodleTop, Sand City, Calif.

[ * ] Notice: The term of this patent shall not extend beyond the expiration date of Pat. No. 5,324,226.

[21] Appl. No.: 266,971

[22] Filed: Jun. 27, 1994

Related U.S. Application Data

[63] Continuation of Ser. No. 770,513, Oct. 2, 1991, Pat. No. 5,324,226, which is a continuation-in-part of Ser. No. 615, 682, Nov. 19, 1990, abandoned.

[51] Int. Cl.[6] ..... A63H 1/00

[52] U.S. Cl. ..... 446/264; 446/256; 446/236

[58] Field of Search ..... 446/257, 258, 446/259, 260, 261, 262, 263, 236, 256, 264

[56] References Cited

U.S. PATENT DOCUMENTS

| | | | |
|---|---|---|---|
| 93,760 | 8/1969 | Sparks | 446/264 |
| 188,174 | 3/1877 | Packer | 496/256 X |
| 327,043 | 9/1885 | Weber | 446/264 |
| 541,802 | 6/1895 | Barus | 446/264 X |
| 668,607 | 2/1901 | Wheeler . | |
| 1,321,035 | 11/1919 | Harlan . | |
| 1,377,544 | 5/1921 | Angell . | |
| 2,618,891 | 11/1952 | Pepin . | |
| 2,945,696 | 7/1960 | Johanningmeir | 446/256 X |
| 3,025,632 | 3/1962 | Brooks . | |
| 3,083,498 | 4/1963 | Kelley | 446/256 X |
| 3,191,341 | 6/1965 | Martin | 496/264 |
| 3,510,949 | 5/1970 | Christy . | |
| 3,861,966 | 1/1975 | Lindquist . | |
| 4,906,216 | 3/1990 | Abeshouse | 446/264 X |

FOREIGN PATENT DOCUMENTS

| | | | |
|---|---|---|---|
| 2614800 | 11/1988 | France . | |
| 5172 | 2/1913 | United Kingdom | 446/264 |
| 1250360 | 10/1971 | United Kingdom | 446/264 |

*Primary Examiner*—Sam Rimell
*Attorney, Agent, or Firm*—Donald S. Dowden

[57] ABSTRACT

A top is provided with a conical body having a soft porous parabolic point at the top's conical apex which simultaneously grips and tracks a writing surface over which the top travels. When the top is spun, the point at the apex grips the writing surface and allows the top to travel over the writing surface leaving an ink imprint in its path. During spinning, the top precesses with the rotating angular velocity characteristic of a top spinning down about a fixed point. However, the tip of the top at the conical apex does not remain fixed with respect to the writing surface; rather, the tip travels on its own course over the writing surface as a function both the angle of the tip with respect to the writing surface and the angular spin velocity of the top. As a consequence, the travel of the tip interacts with the forces of top precession to produce a group of characteristic traced spirals on the writing surface. In one embodiment of the invention, provision is made to vertically adjust the tip of the top in elevation with respect to the remaining mass of the top to adjustable vary the resultant spirals. A serendipitous result of the combination is that ink filled writing instrument in the top experiences a complete exhaustion of its contained ink supply before ceasing to write—a condition not experienced by most such pens during there in service life.

1 Claim, 4 Drawing Sheets

TOP WITH PRECESSION TRACING POINT FOR TRACING UNIQUE SPIRALS

This is a continuation of U.S. Ser. No. 07/770,513 filed Oct. 2, 1991, now U.S. Pat. No. 5,324,226, which is a continuation-in-part of U.S. Ser. No. 07/615,682, filed Nov. 19, 1990 now abandoned for Top With Precision Tracing Point For Tracing Unique Spirals.

BACKGROUND OF THE INVENTION

Rotating or spinning tops are well known. Conventional tops are typically symmetrical and spin rapidly about their symmetrical axis, also referred to as the spin axis. The top typically spins at a lean relative the vertical. The amount of lean is referred to as the precession angle. When the bottom point of the top is substantially fixed in position relative to the surface or table, the top will move about the vertical axis and sweep out a cone-shaped area as a result of this lean. This motion is called precession. When the bottom point is allowed to move or travel, the spin and precession of the top causes the top to move across the supporting surface.

The characteristic movement of a top can be traced if the bottom point is constructed to leave a legible trail. The general concept of forming a top using a writing instrument as the bottom point is not new. Many toy tops use this principle to provide amusement to the user by producing a graphic of the path of the top. For example, the prior art contains many examples of toy toys having writing points. The general concept is taught in U.S. Pat. No. 2,618,891 which uses a ball point pen top, U.S. Pat. No. 3,025,632 for an amusement apparatus and U.S. Pat. No. 3,861,077 which uses a pencil or ball point pen as part of the top.

To facilitate a legible mark traced by the top, prior art devices commonly use a ball point pen structure. Tops rotating upon ball points trace a resulting path which may be described as a chain of interconnected loops. Ball points, due to the roller surface, cannot directly transfer all the top's rotational and precession forces to the supporting surface. Writing tops using ball point pens do not naturally precess, as the precession phenomena of rapidly rotating tops is traditionally observed, due to the ball point's natural tendency to roll with respect to the writing surface. A ball point top tends to wander and fall over as the top acquires a precession angle sufficient to cause the roller point to roll out from under the axis of spin.

Writing tops have not been limited to ball point writing tips, however. Alternative tips on writing tops have been used. For example, lead pencils and chalk tips have been used to more accurately trace a top's full precession. These types of instruments are unfavorable because they require a top with excessive weight to provide the necessary force to cause the lead or chalk to inscribe the writing surface. Therefore, there are disadvantages associated with the use of ball points or pencil lead writing tops. To provide a writing top which can be inexpensively produced, however, conventional and low cost writing devices must be employed.

Soft porous tipped writing instruments are known and can be inexpensively produced. Typical soft porous tips, sometimes referred to as "felt" tip pens, have a fibrous nib which includes a writing tip and a shaft. The shaft is in communication with an ink reservoir. The ink reservoir contains a supply of liquid ink which is absorbed into the nib and thereby feeds ink to the writing point. When the ink laden writing point is placed in contact with a writing surface such as paper, the ink flows onto the writing surface leaving a mark. Due to this free flow of ink, however, if there is no relative movement between the writing tip and the writing surface, the ink may continue to flow onto the writing surface and create an undesirable blot or spot at the point of contact with the paper or surface.

DISCOVERY

A soft porous tip writing instrument has an interesting and unique feature which distinguishes it over alternative writing devices, especially ball point pens. The present inventors have discovered that when a soft porous tip pen is inclined at an angle on a writing surface and rotated, writing also occurs. The reader may easily demonstrate this effect.

Place a piece of paper on a smooth surface. The paper and the surface should have a relatively low coefficient friction so that the paper readily slides relative to the supporting surface. Then position the writing point of a soft porous tip pen on the paper at an angle of inclination. The pen may have a point or may be of a squared, rounded or angled shape. While holding the pen in a stationary location relative to the surface supporting the paper, rotate the pen along its longitudinal axis.

Two effects will be observed.

First, the paper will slowly rotate propelled by the friction of the soft porous tip as it is rotated. Second, the soft porous tip pen at its point will gradually trace a path— spiral path—on the paper as the paper slowly rotates. Neither ball point pens nor pencils offer this unique characteristic.

In the disclosure that follows, I use the characteristic spiral pattern that I have discovered with respect to a rotating soft porous tip pen to interact with the natural forces of precession existing when a top rapidly spins. As a result, I obtain a unique spiral patten not achieved by prior art tops having writing tips. There results beautiful, almost three dimensional traced pattern by the toy top of my invention. The spiral produced will always be unique, never exactly duplicated. My invention combines a soft porous tip writing instrument with a conical shaped top body portion to provide a device which can be adjusted.

SUMMARY OF THE INVENTION

The invention is a toy top having a conical body and removable soft porous generally elliptical tipped writing instrument disposed along the central axis of the conical body. The writing instrument can be made removable from the body and adjustable in position within the body. The soft porous elliptical tip of the writing instrument acts as the pivot point for the top when spun. The porous tip simultaneously grips and tracks a writing surface over which the top travels by leaving an ink trail in its path.

During spinning, the top precesses with the rotating angular velocity characteristic of a top spinning down about a fixed point. However, the point of the top at the conical apex does not remain fixed with respect to the writing surface; rather, the point travels on its own course over the writing surface as a function both the angle of the top with respect to the writing surface and the angular spin velocity of the top. As a consequence, the travel of the point interacts with the forces of top precession to produce a group of characteristic traced spirals on the writing surface. In one embodiment, provision is made to vertically position the point of the top in elevation with respect to the conical body of the top to adjustably vary the resultant spirals. A serendipitous result of the combination is that the soft porous tip writing instrument utilized experiences a complete exhaustion of its contained ink supply before ceasing to write—a condition not experienced by most such pens during their service life.

Other Objects, Features and Advantages

An advantage of the interaction between the precession of the conical top and the angled and rotating disposition of the soft porous tip writing instrument with respect to the paper can readily be observed. Specifically, if the top is spun by the user with its axis at an angle to a writing surface and released to the writing surface, a changing spiral pattern will be observed. Frequently, this pattern will initially have a large diameter of spiral. During the lifetime of the top rotation, the diameter of the spiral will gradually decrease—sometimes the spiral will become so small that the tip of the top actually traces a point. As the spin lifetime of the top nears its end, the spiral will expand again. The spirals will finally expand until, just before the moment of toppling, a large spiral will be produced. As a result, an amusing graphic is dynamically created for the viewer.

A further advantage of the disclosed top is that it has conical sides configured at an angle of about 45°. These conical sides at the moment of top toppling come into contact with the writing surface and react with the writing surface. As a result, the top at the soft porous tip point skids across the writing surface with a terminal signature of reverse curvature with respect to the more normally produced curvatures characteristic of the tracing pattern of the top during normal operation.

An additional advantage of the top is that the writing surface itself can be tilted by a user during top operation. As a result, the traced path can be made to vary its course—but only with difficulty. As a consequence, an amusing and difficult game results which is not easy to master.

One object of the invention, therefore, is to produce a toy top which is lightweight, inexpensive to manufacture and produces a colorful trace of the unique precession of the top when spun.

Another object of the invention is a top which has a removable soft porous tip writing instrument disposed about the spin axis. The removable writing instrument allows the user to exchange writing instruments to combine or vary the color of the graphic produced. Additionally, the writing instrument can be used independently as a normal pen by the user.

A further object of the invention is a top which is amusing and safe for child use. The top uses non-toxic ink in bright colors and has a cap to cover the soft porous tip. The adjustability of the writing instrument along the axis of the top allows the soft porous tip to be positioned in close proximity to the conical body of the top and therefore prevent to tip from contacting the writing surface when the top is resting on its side.

DETAILED DESCRIPTION OF THE PREFERRED EMBODIMENT

Figure 1:
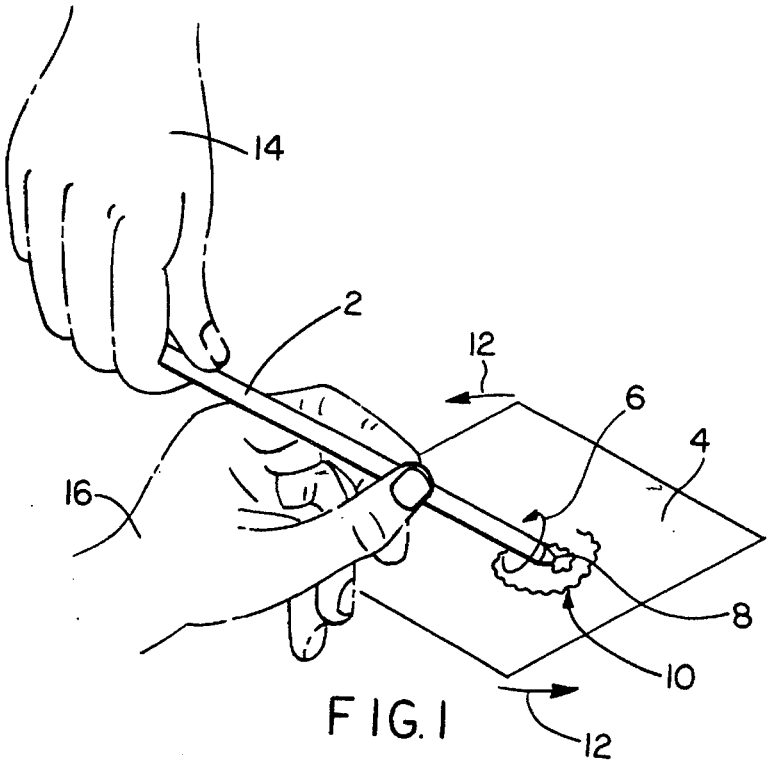
FIG. 1 is an illustration of my discovery showing a soft porous tip pen held in position and being rotated by a user, causing the paper to rotate as the pen traces spirals on the paper.

FIG. 1 illustrates the underlying discovery of the invention. When one grasps a soft porous tip pen 2, such as a felt tip pen, and places the soft porous tip 8 on a piece of paper 4 which is supported on a smooth, low-friction surface, the pen 2 being supported in position by one hand 16 at an angle of inclination relative to the paper 2 and rotated by a second hand 14 as indicated by rotational arrow 6, the rotational movement will cause the paper 4 to rotate as shown by arrows 12. The pen 2 must be held in a stationary position as it is rotated. The rotational forces cause the soft porous tip 8 to frictionally propel the paper 4 and trace a spiral ink path 10 on the paper 4. The ink path 10 illustrated in FIG. 1 is characteristic of a squared or non-round soft plastic or felt tip. The rotational velocity of the paper 4 and the diameter of the resulting ink spiral 10 will vary depending on the contour of the felt tip 8 and the angle of inclination of the pen 2. It is this basic principle which is used in the invention to create unique graphic patterns as the device rotates.

Figure 2:
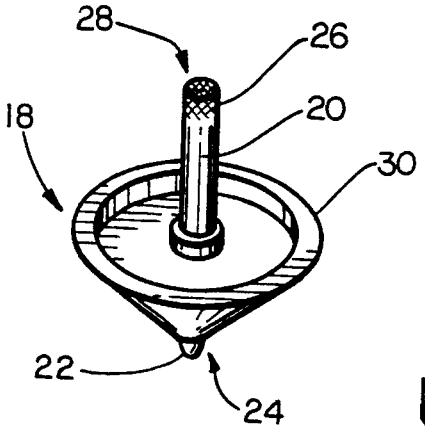
FIG. 2 is a perspective view of the preferred embodiment of the invention showing the soft porous tip pen disposed in the conical body.

Referring now to FIG. 2, the top 18 is shown assembled in perspective view. Top 18 is assembled from a marker 20 centrally disposed in a conical body 30. In the embodiment described, marker 20 and body 30 are separate components. In an alternative embodiment, marker 20 and body 30 can be a single, solid unit where marker 20 forms a shaft extending up from body 30. The marker 20 has a porous soft plastic tip 22 at its distal end 24 and a gripping surface 26 at its proximal end 28. In the preferred embodiment, soft porous tip 22 is made of an FDA, omni-directional porous polyethylene material forming an elliptical nib such as the nib manufactured by Porex Technologies Corp. of Fairburn, Ga. under Part No. X-4500 or suitable alternatives. Tip 22, 54 can be made from a wide range of porous plastics or a fibrous felt material. Preferably, however, the material selected provides a smooth writing tip and is resistant to deformation under ordinary use. Marker 20 is removably inserted into conical body 30 such that the cone shape of the body 30 tapers down towards the soft porous tip 22 at an angle preferably of 45°.

The removability feature of the marker 20 performs three functions. First, the marker 20 can be completely removed from the conical body 30 to aid in packaging and shipping of the invention. Second, the marker 20 can be used independently of conical body 30 as a writing instrument. Third, marker 20 can be adjustably positioned within conical body 30 to vary the spin characteristics of the top 16 as will be discussed more fully below.

Figure 3:
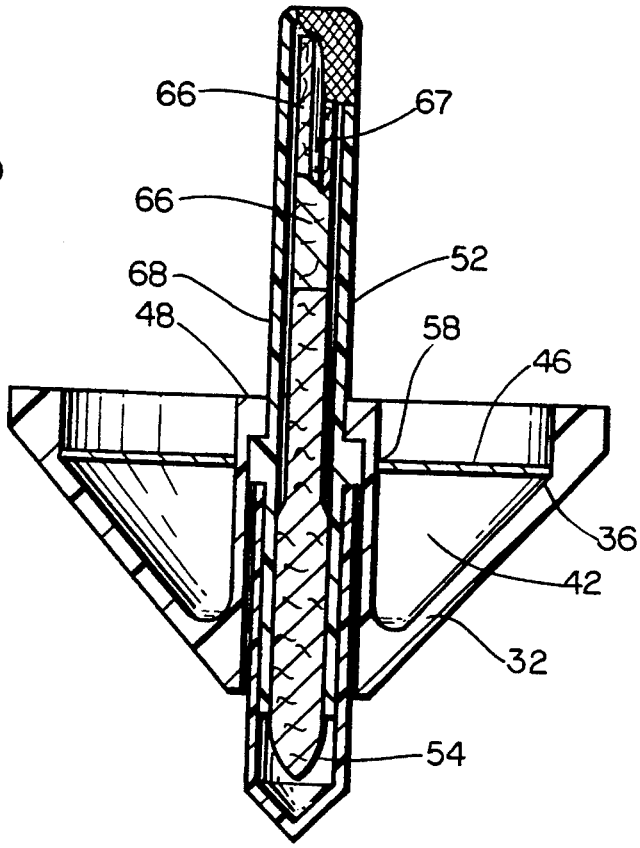
FIG. 3 is a side elevation in section of the assembled invention showing the component parts of the pen with the soft porous tip writing point covered by the removable cap.
Figure 4:
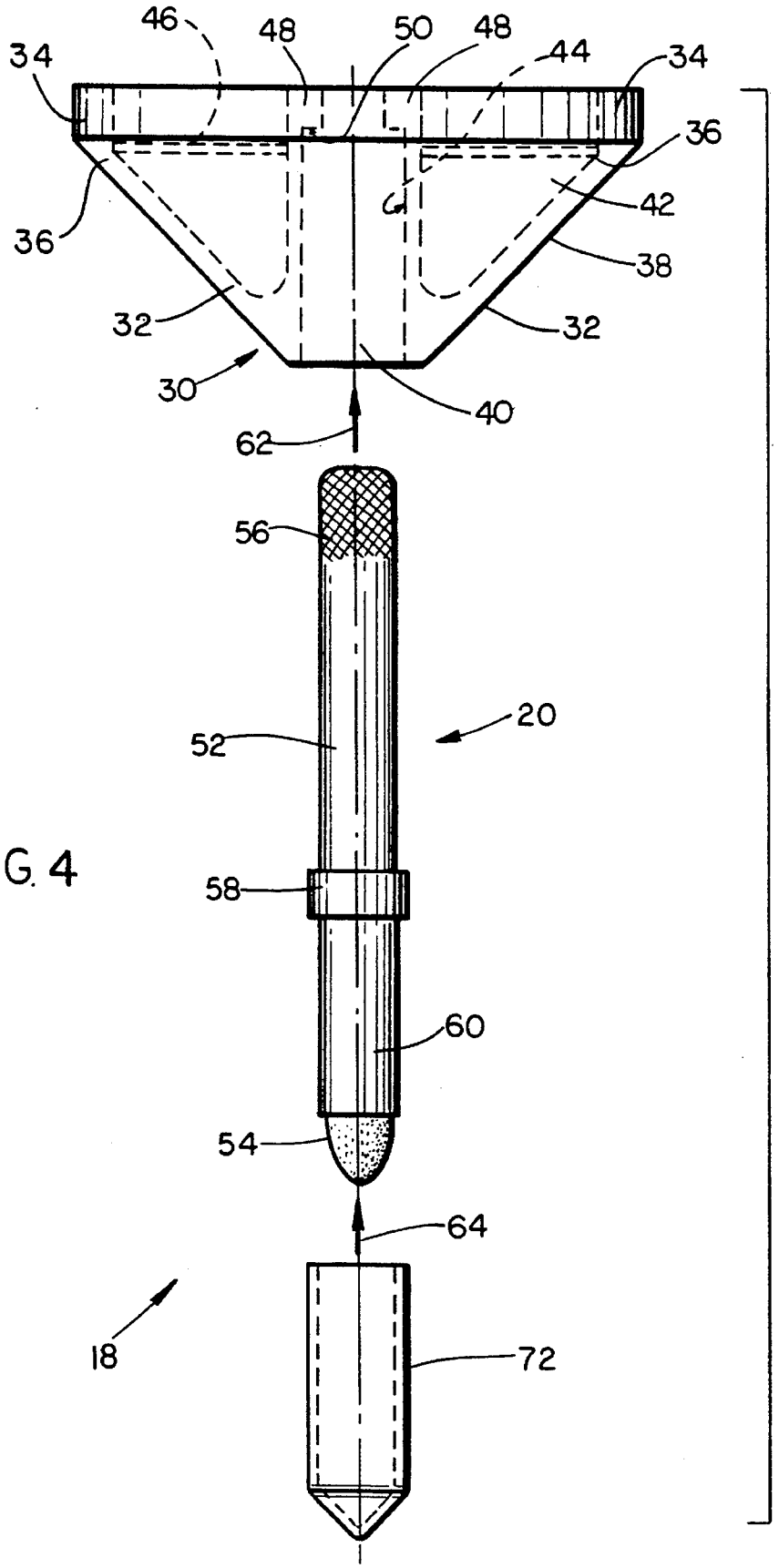
FIG. 4 is a side elevation of the component parts of the invention in the unassembled condition with arrows indicating the relative positioning of the components for assembly.

FIGS. 3 and 4 illustrate the component parts of top 18. FIG. 3 shows top 18 in the assembled condition and FIG. 4 shows top 18 in the unassembled condition. Referring now to FIG. 4, top 18 has a conical body 30, a marker 20 and a cap 32. Conical body 30 is preferably formed out of lightweight molded plastic and can be fabricated using a minimum of material. Conical body 30 is formed having a cone shaped outer surface 38 and a central aperture 40. In the preferred embodiment, conical body 30 has a symmetrical recess 42 between the inner support cylinder 44 and side walls 32. An upper rim 34 is made integral with side walls 32 and forms a shoulder 36. A disk insert 46 is disposed in the recess 42 and is supported by a shoulder 36. Disk insert 46 is held into position in the recess 42 by a friction fit between upper rim 34 and the outer surface of inner support cylinder 44. In the preferred embodiment, disk insert 46 is fabricated from cardboard material to minimize cost of materials and weight. The upper surface of disk insert 46 may be printed with a colorful graphic design prism, or hologram to enhance aesthetics. Conical body 30 is preferably made of a bright color plastic or coated with a chrome colored material.

Inner support cylinder 44 has a hub 48 formed about its periphery. The lower surface of hub 48 forms a stop 50 which is used to limit travel of marker 20 when marker 20 and conical body 30 are assembled together.

Marker 20 includes a shaft 52 housing a nib with a soft porous tip 54 at its lower end 60 and having a gripping surface 56. Gripping surface 56 is textured to provide traction for spinning top 18 with one's fingers when the top is assembled and spun. Collar 58 is formed on shaft 52, preferably near the midpoint of shaft 52. A cap 72 is provided which fits over the lower end 60 of shaft 52 as indicated by arrow 64 to cover soft porous tip 54 and prevent drying out or unwanted contact with ink in marker 20.

Top 18 is assembled by sliding marker 20 into aperture 40 of conical body 30 as indicated by arrow 62. Once assembled, shaft 52 contacts hub 48 and collar 58 contacts inner support cylinder 44 to centrally align and position marker 20 in conical body 30. The contact points between shaft 52 and hub 48, and collar 58 and inner support cylinder 44 are made slidable to allow marker to be adjustably positioned in conical body 30. This adjustability allows the assembled top's center of gravity to be modified by moving marker 20 along the longitudinal axis of inner support cylinder 44. As a result, the soft porous tip 54 can be adjustably positioned relative to conical body 30. The greatest distance soft porous tip 54 is positioned away from conical body 30, the higher the top's center of gravity and the larger the resulting spiral will be. Stop 50 limits the positioning of collar 58 toward hub 48.

Once assembled, top 18 appears as shown in FIG. 3. Referring now to FIG. 3, additional detail of marker 20 will be discussed. Marker 20 has a shaft 52 which houses an ink reservoir 66 communicating to a nib 68 formed with an elliptical point 70 which externally extends outside of the shaft 52 at the distal end of the marker 20. Collar 58 is shown fully inserted into conical body 18 where it engages stop 50. The inner diameter of the inner support cylinder 44 engages the outer surface of collar 58 providing a friction fit between conical body 30 and marker 20. Hub 48 centrally aligns and supports shaft 52 when marker 20 is disposed within the conical body 30. Cap 48 is shown inserted over the soft porous tip 54 where it frictionally engages the lower end 60 of shaft 52 providing an airtight seal for preventing the elliptical point 70 from drying out when in communication with ink from ink reservoir 66. There is sufficient clearance between lower end 60 of shaft 52 and the walls of aperture 40 to allow cap 72 to slide on and off marker 20 when marker 20 is assembled into conical body 30.

In the preferred embodiment of the invention, the plastic used to make marker 20 should have a sufficient degree of resiliency to prevent cracking or breaking when the apparatus is dropped or stepped on by the user. During manufacturing, fiber ink reservoir 66 having a venting channel 67 is inserted into the shaft 52 of marker 20. The reservoir 66 is then saturated with a bright colored or florescent non-toxic writing ink (not shown) and nib 68 is placed in connection with reservoir 66 within shaft 52 such that the soft porous tip 54 of nib 68 extends outside of shaft 52 at the distal end of the marker 20. As such, the ink can be communicated from reservoir 66 to the soft porous tip 54 by capillary attraction to facilitate writing when tip 54 is placed in contact with a writing surface. In all other respects, marker 20 is constructed using standard ink marker construction techniques and tolerances which are conventional in the writing instrument art.

The parabolic shape of tip 54 in the preferred embodiment provides a smooth yet porous surface to communicate ink to a writing surface such as paper regardless of the angle of rotation or spin of top 18 and provide a surface for communicating the precession forces of the top to the writing surface. Tip 54 is made firm enough to withstand prolonged use and resist deformation upon repeated spins and bounces.

Figure 5:
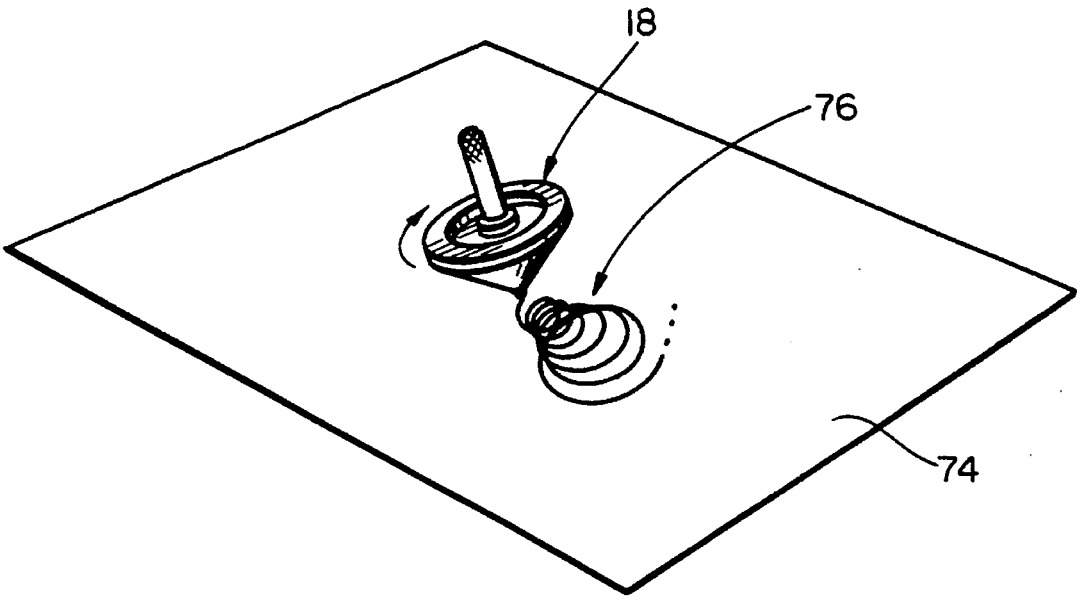
FIG. 5 is a perspective view of the invention spinning on a piece of paper with the soft porous tip of the top tracing the rotational and precession forces of the top.

Referring now to FIG. 5, when the top 18 is assembled having marker 20 disposed in conical body 30 with the soft porous tip 54 exposed, the user can place top 18 above a writing surface 74 and spin the top such that soft porous tip 54 contacts the writing surface as the top rapidly spins about its spin axis. The ink contained in the marker 20 will trace the path of the top 18 as it travels across writing surface 74. The combination of the unique characteristics associated with a soft porous point marker as previously discussed in combination with the configuration of conical body 30, result in a unique graphical trace of the path 76 of the top as it rapidly rotates upon the writing surface 74.

Figure 6:
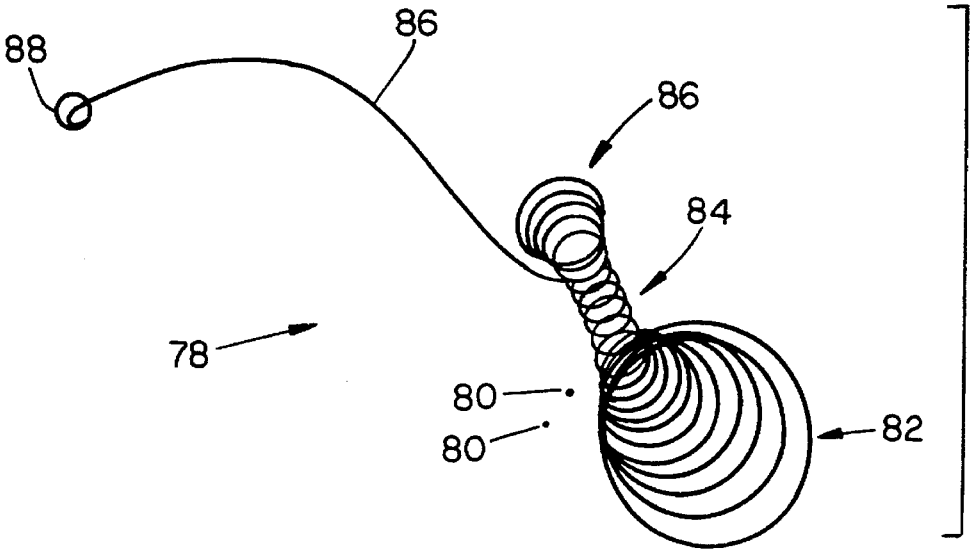
FIG. 6 is a compressed and reduced in size example trace of the unique pattern produced by the invention illustrating the initial large spirals, the smaller diameter intermediate spirals, and the final spirals enlarging and ending with a characteristic termination signature of reverse curvature.

FIG. 6 illustrates a typical path trace 78 produced by the top 18 as it rapidly spins on a writing surface 74. A typical, yet always unique, path trace 78 is characterized by initial contact marks 80 where the top 18 initially drops onto the writing surface 74 and bounces until the soft porous tip 54 is in rotational communication with the writing surface 74. Alternatively, rotation can begin while in contact with writing surface 74 therefore eliminating initial bounce and contact marks 80. Once in rotational communication, top 18 traces overlapping spirals beginning first with a large spiral region 82 composed of spirals having decreasing diameter as the top spins through its spin life. The ink trace of large spiral region 82 converges down to a narrow spiral region 84 before it typically again increases in spiral diameter forming an enlarging spiral region 86. As top 18 continues decreasing in rotational velocity, it spins a trace of a finishing trail 86 and completes its rotation with a characteristic signature 88 as the angular lean of top 18 increases and the cone shaped outer surface 38 contacts the writing surface 74. This unique trace is a result of the construction of top 18 and the shape of elliptical tip 54. Many trace variations can be made by angling the writing surface 74, the initial spin angle, or the velocity of spin.

Figure 7:
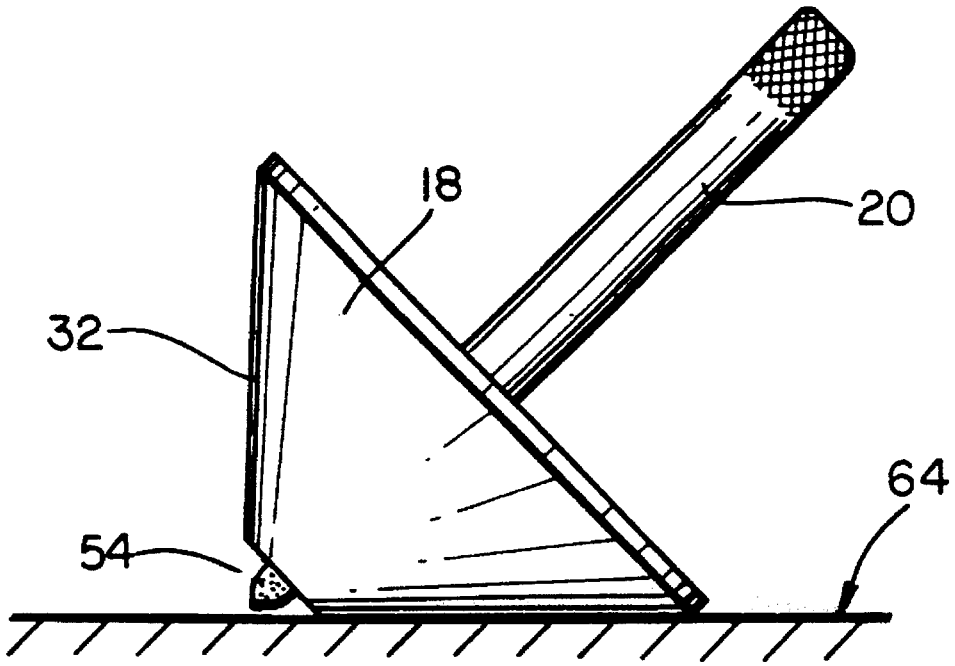
FIG. 7 is a side elevation view of the assembled invention resting upon a surface with the soft porous tip pen positioned such that the soft porous tip does not bleed on the surface.

Referring now to FIG. 7, upon completion of the spin life, top 18 comes to rest on the writing surface 74. The marker 20 can be positioned inside the conical body 30 before or after it is spun such that the soft porous tip 54 does not contact the writing surface 74 when the top 18 is at rest as shown. This feature allows the marker 20 to be positioned such that ink blots produced by bleeding soft porous tip markers in conventional tops are completely avoided.

In the preferred embodiment, top 18 is fabricated along with conical body 30 and marker 20 with materials having bright colors. Conical body 30 and marker 20 can be made of matching or contrasting colors. Marker 20 can be fabricated using any possible color of ink, however, in the preferred embodiment bright or florescent colored ink is used. The ink is made non-toxic and non-permanent so as to be safe when used by young children.

It should be noted that cap 32 is made having a generally pointed conical distal end which can also be used as a pivot point for spinning. Therefore, top 18 can be spun with cap 32 positioned on marker 20 to create a precession similar to conventional toy tops. As a result, top 18 provides an entertaining novelty play toy which is safe and amusing for children of all ages.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and scope of the invention. For example, marker 20 and body 30 can be made integral and formed from a single piece of material. Additionally, a wide range of materials could be used in fabricating body 30, such as paper, rubber, glass, ceramics, alloys or polymers. The embodiments described in this description was selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. In combination:

a top having a conical body with 40° to 50° truncated cone with respect to the horizontal and having a rotational moment of inertia for retaining dynamically imparted angular momentum to said top during a spin time of said top when said top is spun, the conical body including a central shaft having a bore;

a writing surface for permitting passage of a writing point over said surface, said writing surface providing a frictional engagement between said writing point and said writing surface and receiving a track from said point;

a writing point comprising a porous plastic tip having a generally parabolic vertical cross-section and providing non-slipping rotational contact with a writing surface, said porous tip in communication with an ink source at least partially positioned within said bore and leaving a trace in the wake of said non slipping rotational contact on said writing surface whereby said point leaves on said writing surface spiral tracks having the characteristic of initial large diameter traced spirals, intermediate narrow spirals, and terminal large diameter traced spirals relative to a spin time of said top.

* * * * *